US006216564B1

(12) United States Patent
Pasbrig

(10) Patent No.: US 6,216,564 B1
(45) **Date of Patent: *Apr. 17, 2001**

(54) UNIVERSAL WRENCH

(75) Inventor: Max Herbert Pasbrig, Orselina (CH)

(73) Assignee: Lacrex-sa, Orselina (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/316,003

(22) Filed: May 21, 1999

(51) Int. Cl.[7] ..... B25B 13/22
(52) U.S. Cl. ..... 81/135; 81/127
(58) Field of Search ..... 81/135, 127, 356, 81/91.2, 3.44

(56) References Cited

U.S. PATENT DOCUMENTS 2,397,095 * 3/1946 Emmett ..... 81/356
2,481,866 * 9/1949 Petersen ..... 81/356
2,500,461 * 3/1950 Lazzarini ..... 81/356
2,589,565 * 3/1952 Minton ..... 81/356
3,572,190 * 3/1971 Oeland, Jr. ..... 81/127
3,815,447 * 6/1974 Sterling ..... 81/3 R
4,785,495 * 11/1988 Dellis ..... 16/111 R
4,949,576 * 8/1990 Floyd ..... 81/3.44
5,016,503 * 5/1991 Morton ..... 81/127
5,095,782 * 3/1992 Galea ..... 81/127

* cited by examiner

*Primary Examiner*—James G. Smith
*Assistant Examiner*—Hadi Shakeri
(74) *Attorney, Agent, or Firm*—Millen, White, Zelano & Branigan, P.C.

(57) ABSTRACT

The universal wrench has a handle and a wrench body with reciprocally displaceable jaws and part-gripping teeth. An abutment end portion of the handle has circularly arranged teeth that cooperate with teeth on a rack provided on one of the jaws. The rack is reciprocally guided in the other jaw. A spring is secured to the handle and to this other jaw. A latch pin presses against the lower circular surfaces of this other jaw to secure the handle in different pivoting positions.

9 Claims, 2 Drawing Sheets

UNIVERSAL WRENCH

BACKGROUND OF THE INVENTION

This invention relates to a universal wrench. The wrench has an open wrench body that is attached to the end of a handle or a device formed at the end of a handle, for clamping and holding fast, and then releasing a bolt head or like connecting element, or rods, pipes, etc.

Known wrenches of this kind have the disadvantage that round bolt heads or like connecting elements, and rods and pipes cannot be securely clamped, held fast, and released.

SUMMARY OF THE INVENTION

The object of the invention is to provide a universal wrench that with its wrench body is able to securely clamp, hold fast, and release even round bolt heads and like connecting elements, and rods, pipes and like parts of different shape and size.

This object is achieved according to the invention, by a universal wrench having at least one open wrench body attached at the end portion of a handle or a device formed at the end of a handle. The wrench body is pivotable in a gripping plane relative to the handle. A shaft is attached to the handle and stands perpendicularly to the gripping plane. First and second jaws are mounted to pivot about the shaft in the gripping plane. A guide is provided on the first jaw and runs at right angles to the gripping plane. A rack is provided on the second jaw at right angles to the second jaw. The rack is guided for longitudinal displacement in the guide and has teeth directed towards the handle. A series of teeth are provided at the end portion of the handle, with the teeth arranged in a circular arc with a mid-point formed by the shaft. These teeth engage the teeth on the rack.

It has been found to be particularly advantageous for the handle to have an abutment portion with a tooth system with rounded recesses and projections. The wrench body has two jaws that are reciprocally displaceable. The first jaw is rotatable about a shaft mounted in the handle and is held in the clamping position by a spring. The second jaw has recesses and projections that match those of the abutment portion. The jaws are provided on their mutually facing inner sides with recesses that ensure better seating on the part to be clamped.

To accomodate conventional hexagonal nuts, the recesses have surfaces that include an angle of 120 and form sides of an equilateral triangle.

The inner sides of the jaws are provided with edges to ensure a good grip on round parts such as pipes. The inner sides of the jaws are also provided with teeth that form gripping surfaces. A ratchet-like latching between the jaws and the handle can result from appropriately constructing and arranging the teeth and the spring.

A further advantage results from a spring that has one end mounted on the shaft on the handle or on a pin elastically mounted in the handle. The other end of the spring is mounted on the jaw that is pivotably held by the shaft. The handle and the jaw are thus better held in the desired position to assure that a bolt or other connecting element is securely held.

Possibile uses of a universal wrench according to the invention are expanded when the abutment portion is connected to the end of the handle via a shaft lying in the gripping plane of the wrench body. In this arrangement, the abutment portion can be rotated perpendicularly to the gripping plane, as is known from Swiss Patent 382,044. This arrangement is therefore not shown and described in more detail.

DESCRIPTION OF THE DRAWINGS

Preferred embodiments of the invention will be explained in more detail with reference to the accompanying drawings, in which.

DETAILED DESCRIPTION OF PREFERRED EMBODIMENTS

Figure 1:
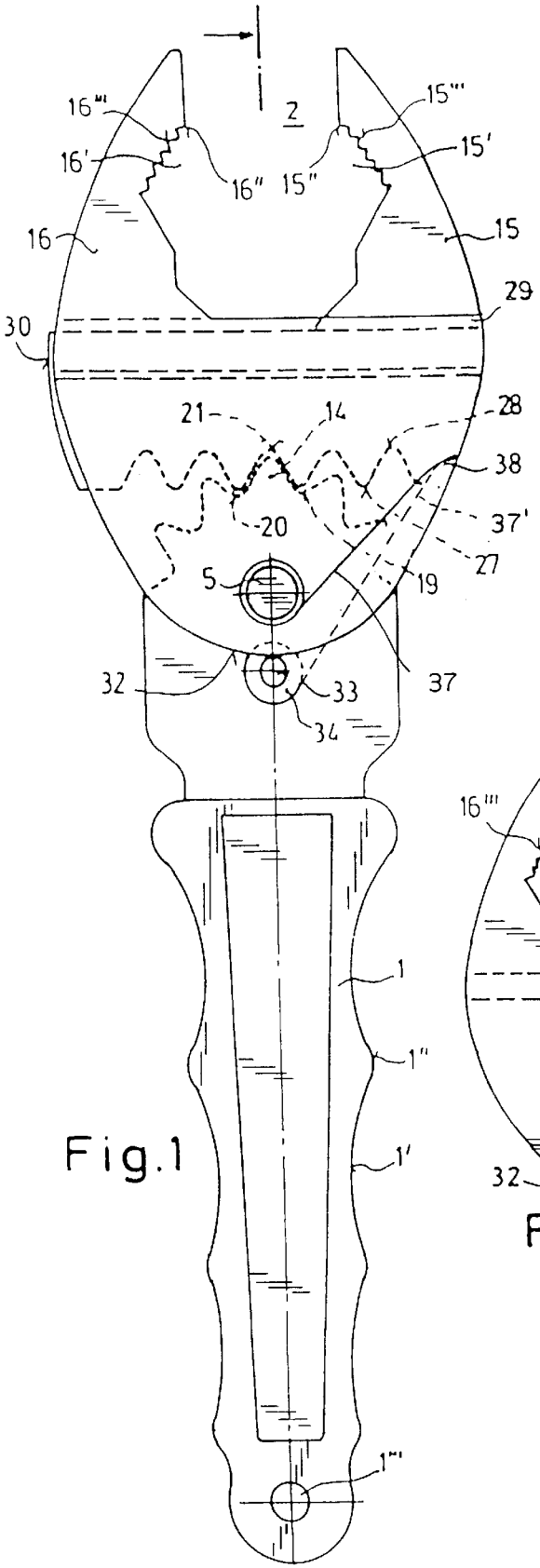
FIG. 1 shows a plan view of the universal wrench.
Figure 2:
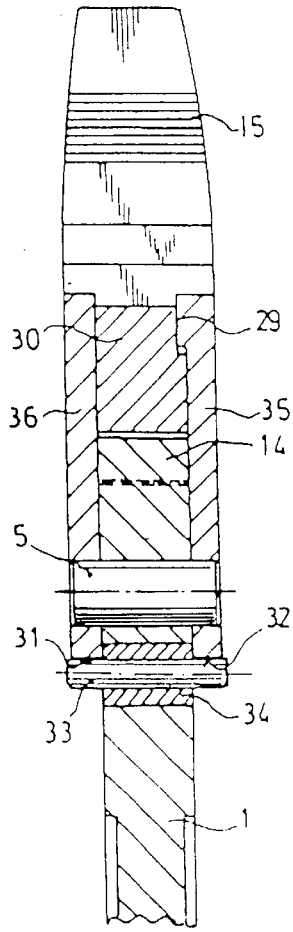
FIG. 2 shows a longitudinal section through the universal wrench shown in FIG. 1.
Figure 3:
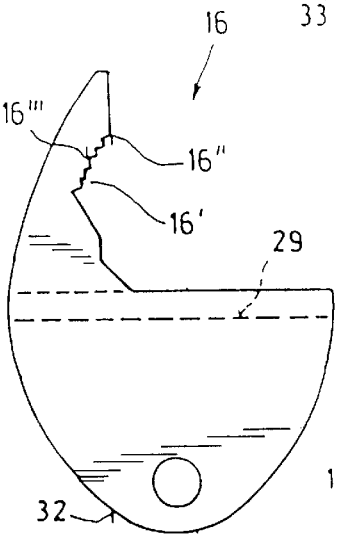
FIG. 3 shows a plan view of the first jaw.
Figure 4:
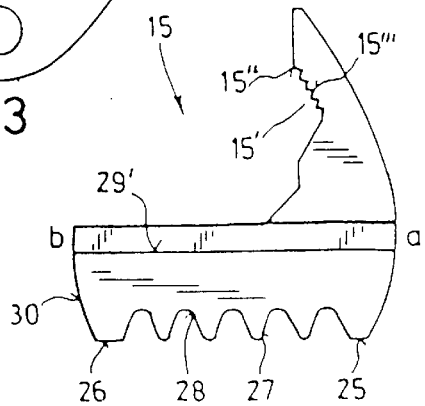
FIG. 4 shows a plan view of the second jaw.
Figure 5:
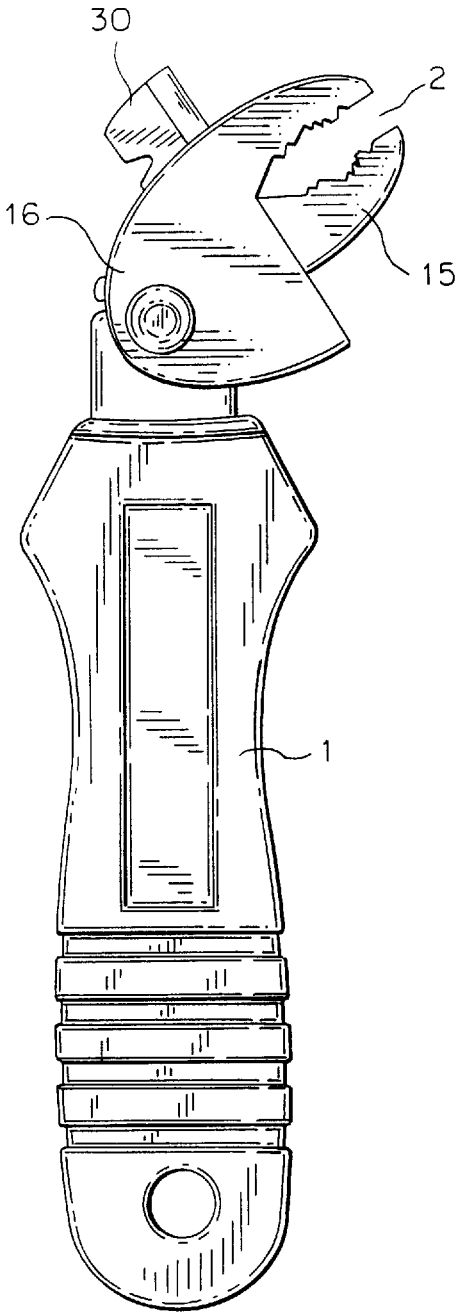
FIG. 5 is a view similar to FIG. 1, but showing the reversal wrench in a position in which the bias of a spring urges the jaws of the universal wrench to their closed position.
Figure 6:
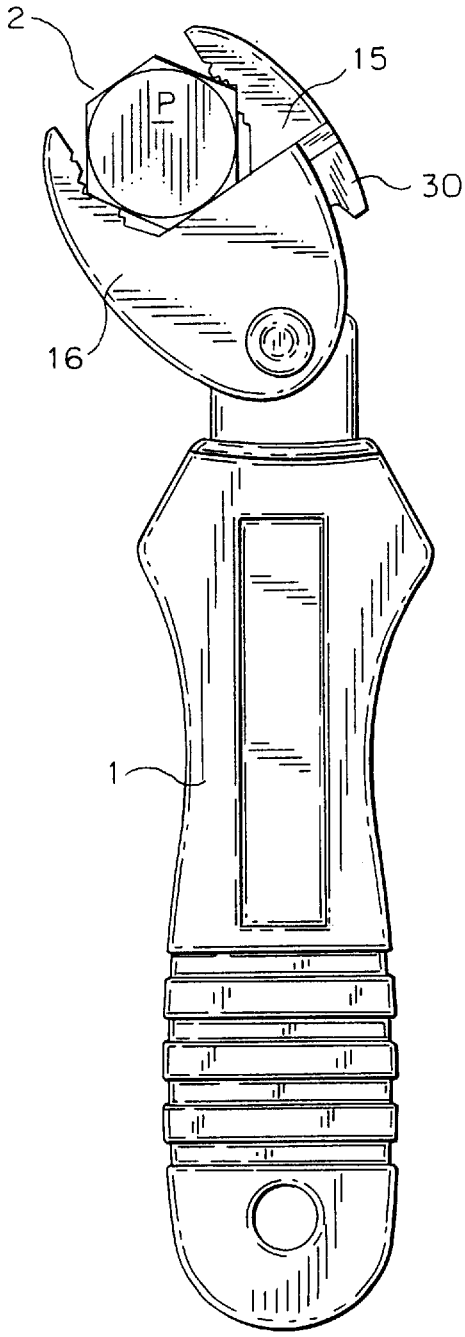
FIG. 6 is a view similar to FIG. 1, but showing the jaws in an opened position wherein the jaws are opened further than in FIG. 1.

The universal wrench has an open wrench body 2 and a handle 1. The handle 1 has an abutment portion 14 with teeth that are formed by rounded projections 21 and rounded recesses 19, 20, arranged on a circular arc, the midpoint of which coincides with the longitudinal axis of rotary shaft 5. The wrench body has two reciprocally displaceable jaws 15, 16. For purposes of this specification jaw 16 is designated the first jaw and jaw 15 is designated the second jaw. Second jaw 15 carries projections 25, 26, 27 and recesses 28 on a slider rack 30 that is guided in first jaw 16. The projections and recesses are arranged in a straight line and match those on the abutment portion 14 with which they engage. Shanks 35, 36 are attached to first jaw 16 and are provided with mounting bores and are pivotably mounted on the shaft 5. Shanks 35, 36 are perpendicular to a guide surface running at right angles to first jaw 16 and forming, together with shanks 35, 36, a guide 29 for the rack 30. The first jaw 15 is attached at right angles to the untoothed rear side of rack 30. First jaw 16 forms with its lateral shanks 35, 36 a forked enclosure of the toothed abutment portion 14 of the handle 1. Shanks 35, 36 have a semicircular shape at their lower ends 31, 32, engaging a latch pin 33 that is enclosed by a sleeve 34 of elastic material and fastened in a bore of the handle 1. First and second jaws 16 and 15 respectively are secured in different pivoting positions relative to the handle 1, because latch pin 33 abuts and presses on the smooth arcuate lower ends 31, 32 of the arcuate shanks.

To support positioning on a connecting element to be gripped, a spring 37 is attached at one end to shaft 5 in handle 1 and is attached at its other end 38 to second jaw 16. In another embodiment shown in broken lines, spring 37, is attached to latch pin 33.

The mutually facing sides of the first and second jaws 16 and 15, respectively are provided with recesses 15', 16'. The clamping faces are equipped with teeth or ribs 15''', 16'''. Corners 15", 16" are provided at the transition from the forward, obliquely running faces of the recesses to the straight running surfaces of the clamp jaws. The corners 15", 16" serve to enclose round pieces and are defined by notches n which extend transverse to parallel surfaces ps.

In operation, pivoting the abutment portion 14 of handle 1 to the right displaces jaws 15, 16 in an opening direction. The universal wrench can thus be seated on connection elements of different sizes, this seating being facilitated in that the play between the jaws and the parts to be gripped can easily be increased by pivoting the handle 1. If the abutment portion of the handle is now pivoted in the opposite direction, to the left, jaws 15, 16 clampingly engage the article to be gripped.

The invention is not limited to the universal wrench illustrated. The adjustable jaw wrench body can also be attached to the handle to rotate about an axis. Likewise, several wrench bodies can be provided on one handle. The wrench body can also be constructed with the abutment portion as an interchangeable component for other suitable universal wrenches.

For the purpose of an improved handling it is provided that the end of the grip is furnished with a covering.l' out of rubber or plastic material which is conplemented with formings l" and with a hanging link l'".

I claim:

1. In a universal wrench having at least one openable wrench body attached at an end portion of a handle for positively holding fast a pan to be gripped, said wrench body being pivotable relative to said handle and having opposed gripping surfaces thereon; the wrench comprising:

a shaft extending parallel to said gripping surfaces for pivotally mounting the wrench body on the handle, first and second jaws mounted to pivot about said shaft, the first and second jaws having the opposed gripping surfaces thereon which grip said part, a spring connected between a location on said handle and said first jaw for urging said first jaw into clamping position with said second jaw to grip said part;

a guide provided on said first jaw and extending transverse to said gripping surfaces, a toothed rack on said second jaw and extending transverse gripping surfaces, said rack being guided for longitudinal displacement in said guide and having teeth directed towards said handle, and a series of teeth provided at said end portion of said handle, the teeth being arranged in a circular arc with a mid-point formed by said shaft and engaging with said teeth on said rack, whereby as the handle is pivoted with respect to the jaws, the jaws move toward and away from one another.

2. A universal wrench according to claim 1, wherein said gripping surfaces comprise surfaces including an angle of 120 degrees and forming sides of an equilateral triangle.

3. A universal wrench according to claim 1, further comprising tooth grooves formed between said teeth on said rack and said teeth at said end portion of said handle, wherein said teeth on said rack and said teeth at said end portion of said handle as well as tooth grooves are rounded.

4. A universal wrench according to claim 1, wherein said guide comprises a groove having lateral shanks that extend beyond said rack and form a forked extension about said end portion of said handle.

5. A universal wrench according to claim 1, wherein said guide comprises a groove having lateral shanks that extend beyond said rack and forming a forked extension about said end portion of said handle, said groove being of tapering form in cross section.

6. A universal wrench according to claim 4, further comprising a latch pin elastically fastened to said handle and at least one end of said lateral shanks being provided with a circular form that engages said latch pin.

7. A universal wrench according to claim 1, wherein the spring is connected between said shaft and said first jaw to hold the first jaw in a clamping position by holding the part between the first and second jaws.

8. A universal wrench according to claim 1, further comprising a covering out of rubber or plastic material which is complemented with hand grip indentations and with a hanging link.

9. A universal wrench according to claim 1 wherein the part to be gripped is polygonal or cylindrical, the opposed gripping surfaces of the first and second jaws having mutually facing converging surfaces thereon which have edges and ribs co-extending with the gripping surfaces, as well as mutually facing diverging surfaces extending from the conversing surfaces toward the handle.

* * * * *

UNITED STATES PATENT AND TRADEMARK OFFICE

CERTIFICATE OF CORRECTION

PATENT NO. : 6,216,564 B1
DATED : April 17, 2001
INVENTOR(S) : Max Herbert Pasbrig It is certified that error appears in the above-identified patent and that said Letters Patent is hereby corrected as shown below:

Column 1,
Line 45, change "120" to -- 120° --.

Column 3,
Line 18, change "pan" to -- part --.
Line 33, after "verse" insert -- to said --.

Column 4,
Line 36, change "conversing" to -- converging --.

Signed and Sealed this

Eighth Day of January, 2002

*Attest:*

*Attesting Officer*

JAMES E. ROGAN
*Director of the United States Patent and Trademark Office*